United States Patent [19]

Farquhar et al.

[11] 4,414,542

[45] Nov. 8, 1983

[54] TWO CHANNEL COMPARISON-TYPE FIRE OR EXPLOSION DETECTING SYSTEM

[75] Inventors: Robert L. Farquhar, Woodley; David N. Ball, Langley, both of England

[73] Assignee: Graviner Limited, England

[21] Appl. No.: 265,016

[22] Filed: May 15, 1981

[30] Foreign Application Priority Data

May 17, 1980 [GB] United Kingdom ..... 8016385

[51] Int. Cl.[3] ..... G08B 17/12

[52] U.S. Cl. ..... 340/578; 250/339; 250/340; 340/587; 340/600

[58] Field of Search ..... 340/578, 587, 600; 250/339, 340

[56] References Cited

U.S. PATENT DOCUMENTS

| | | | |
|---|---|---|---|
| 3,825,754 | 7/1974 | Cinzori et al. | 250/338 |
| 3,859,520 | 1/1975 | Hertzberg et al. | 250/209 |
| 3,931,521 | 1/1976 | Cinzori | 250/339 |
| 4,101,767 | 7/1978 | Lennington et al. | 250/339 |
| 4,160,163 | 7/1979 | Naksuchi | 250/339 |
| 4,206,454 | 6/1980 | Schapira et al. | 250/339 |
| 4,220,857 | 9/1980 | Bright | 250/339 |
| 4,296,324 | 10/1981 | Kern et al. | 250/339 |

*Primary Examiner*—Glen R. Swann, III

*Attorney, Agent, or Firm*—John K. Williamson

[57] ABSTRACT

Photoelectric type detector responds to radiation in a narrow wavelength band characteristic of a fire or explosion, and a slow-response detector, such as a thermopile, is sensitive to radiation in a different narrow wavelength band centered at, for example, 4.4 microns, again characteristic of the same fire or explosion. The electrical outputs of the detectors are fed into a ratio unit which causes an AND gate to produce a fire or explosion indicating output only when the ratio of the output of the thermopile detector to the output of the other detector exceeds a predetermined value.

6 Claims, 2 Drawing Figures

TWO CHANNEL COMPARISON-TYPE FIRE OR EXPLOSION DETECTING SYSTEM

BACKGROUND OF THE INVENTION

The invention relates to fire and explosion detection systems.

Fire and explosion detection systems are known which respond to radiation which is produced by such an event. Specifically, systems are known which use radiation detectors producing an electrical output in dependence on the intensity of the radiation sensed. It is also known to arrange, in such systems, for the radiation detector to be sensitive to radiation in a wavelength band characteristic of the particular type of fire or explosion to be detected. In this way, it is intended that there will be better discrimination against extraneous "noise", that is, other sources or radiation.

An object of the invention is to provide an improved system for detecting fires or explosions. A more specific object is to provide such a system which does not depend on the output of a single detector reaching a predetermined value. A further object of the invention is to provide such a system which gives better discrimiantion against constant high-colour-temperature noise sources.

BRIEF SUMMARY OF THE INVENTION

According to the invention, there is provided a system for detecting fires or explosions emitting radiation having a characteristic wavelength and also emitting radiation at other wavelengths, comprising first radiation sensing means arranged to sense radiation in a narrow wavelength band including the characteristic wavelength and to produce a first electrical output dependent on the intensity of the radiation sensed but delayed with respect thereto, second radiation sensing means arranged to sense radiation in a wavelength band including one of the other said wavelengths and producing a second electrical output relatively instantaneously dependent on the intensity of the radiation sensed, means for measuring the ratio of the two electrical outputs, and output means for producing a fire or explosion indicating output only when the ratio of the first electrical output to the second electrical output exceeds a predetermined value.

BRIEF DESCRIPTION OF THE DRAWINGS

Fire and explosion systems embodying the invention will now be described, by way of example, with reference to the accompanying diagrammatic drawings in which.

DESCRIPTION OF PREFERRED EMBODIMENTS

Figure 1:
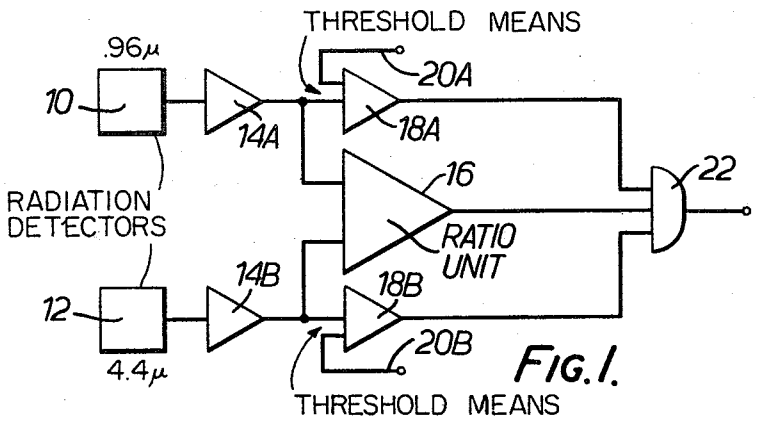
FIG. 1 is a block circuit diagram of one of the system.

As shown in FIG. 1, one form of the system comprises two radiation detectors 10 and 12 each of which produces an electrical output in response to radiation received.

Detector 10 is made to produce an output characteristic of radiation in a narrow wavelength band lying in the range 0.7 to 1.2 microns, e.g. 0.96 microns. For example, the detector 10 may be a photo-electric type detector such as a silicon diode detector arranged to view radiation through a filter transmitting radiation only within the required wavelength band.

The detector 12 is arranged to be sensitive to radiation in a narrow wavelength band centred at 4.4 microns. Specifically, detector 12 is of a type arranged to produce a delayed output. For example, the detector 12 may be a thermopile-type sensor arranged to receive radiation through a filter having the required wavelength transmitting band and thus producing a delayed output because of the thermal inertia of the thermopile. Instead, however, the detector 12 could be in the form of a photoelectric type detector, such as a lead selenide detector, again arranged to receive radiation through a filter having the required wavelength transmitting band, and feeding its output through a signal shaping circuit.

Detector 10 feeds its output through an amplifier 14A to one input of a ratio unit 16, and also to a comparator 18A. The comparator 18A compares the magnitude of the amplifier output with a predetermined threshold value produced by a reference signal on a line 20A and changes its output from binary "0" to binary "1" when the amplifier output exceeds the threshold, and the binary output is fed to one input of an AND gate 22.

Detector 12 feeds its output through an amplifier 14B to the second input of the ratio unit 16 and also to a comparator 18B corresponding to comparator 18A. Comparator 18B receives a reference on a line 20B, representing a predetermined threshold, and again the output of comparator 18B changes from binary "0" to binary "1" when the amplifier output exceeds the threshold represented by the signal on line 20B, and the binary output is fed to a second input of AND gate 22.

The third input of AND gate 22 is fed by the ratio unit 16. The ratio unit 16 is arranged to produce a binary "0" when the amplified output of detector 10 exceeds the amplified output of detector 12, and to switch to binary "1" when the reverse conditions apply.

Figure 2:
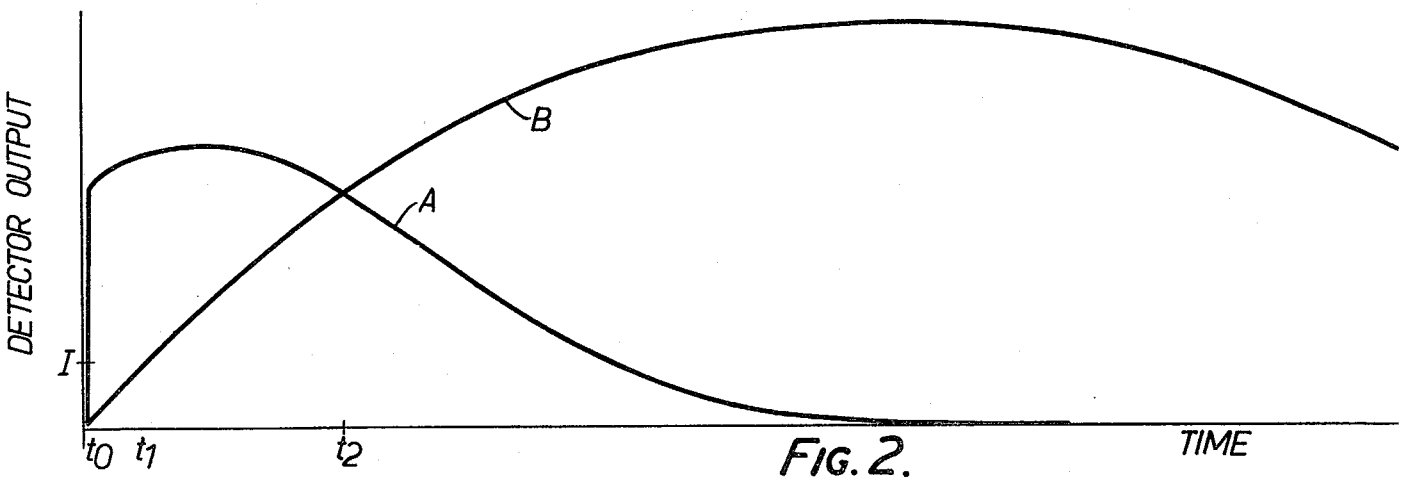
FIG. 2 is a graph showing waveforms occurring in the system.

In FIG. 2, curve A represents the electrical output of detector 10 in response to a fire or explosion, and curve B represents the electrical output of detector 12 in response to that fire or explosion. In this case, the fire or explosion is assumed to be one producing $CO_2$, the characteristic wavelength relating to which is 4.4 microns.

The fire or explosion is assumed to start at time $t_o$. Because of the thermal inertia of the thermopile sensor in detector 12 (or because of the signal shaping circuit in the alternative form suggested above for this detector), curve B rises comparatively slowly in response to the fire or explosion, while curve A rises substantially instantaneously.

The threshold levels applied by the comparators 18A and 18B are shown at I in FIG. 2.

After time $t_1$, both comparators 18A and 18B will be producing "1" outputs. However, as long as the output of amplifier 14B is less than the output of amplifier 14A, the ratio unit 16 will produce a "0" output, and therefore AND gate 22 will produce a "0" output.

At time $t_2$, however, the output of ratio unit 16 will change to "1", and AND gate 22 will now switch to produce a "1" output which indicates the presence of the fire or explosion and can be used to initiate suppression action.

The foregoing applies particularly to the case where the event occurring is an explosion (e.g. an exploding high energy anti-tank (or H.E.A.T.) round striking a battle tank or armoured personnel-carrying vehicle)

which subsequently starts a fire. In this case, therefore, the actual fire may not start until after fire suppression has been initiated (at time $t_2$). However, if the fire is not a fire started in this way by an explosion but is itself the initiating event, then it will be detected in the same way (when the output of the ratio unit 16 switches to "1") but the system is then responding to the actual fire and not "predicting" the fire. However, such a fire (e.g. caused by a leakage of hydraulic fluid in a vehicle) is itself a slower growing fire, and therefore the need for prediction is lessened.

The use of a detector operating at 4.4 microns is advantageous because it prevents the system responding to an extraneous noise such as solar radiation or conventional lighting. The addition of the 0.96 micron detector 10 is advantageous because it ensures that the system initiates warning or suppression action in response to the comparison of the outputs of two detectors and does not depend, for example, on the output of a single detector reaching a predetermined value. In addition, there is better discrimination against constant high colour temperature noise sources. If the threshold levels in both channels are sufficiently high, discrimination can also be provided against infra-red noise sources, such as electric bar heaters or lasers.

What is claimed is:

1. A system for detecting fires or explosions emitting radiation having a characteristic wavelength and also emitting radiation at other wavelengths, comprising first radiation sensing means to sense radiation in a narrow wavelength band including the characteristic wavelength and to produce a first electrical output dependent on the intensity of the radiation sensed but delayed with respect thereto, second radiation sensing means to sense radiation in a wavelength band including one of the other said wavelengths and producing a second electrical output relatively instantaneously dependent on the intensity of the radiation sensed, means measuring the ratio of the two electrical outputs, and output means producing a fire or explosion indicating output only when the ratio of the first electrical output to the second electrical output exceeds a predetermined value.

2. A system according to claim 1, including means responsive to at least one of the first and second electrical outputs to determine when the value of that output exceeds a predetermined threshold and to prevent the production of the said fire or explosion indicating output until the said threshold is exceeded.

3. A system according to claim 1, in which the first radiation sensing means comprises a thermopile sensor, and a filter having a narrow passband including the said characteristic wavelength, the thermopile sensor receiving the said radiation through the filter.

4. A system according to claim 1, in which the first radiation detection means comprises a photo-electric type sensor, a filter having a narrow passband including the said characteristic wavelength and through which the photo-electric type sensor receives the said radiation, and a signal shaping circuit responsive to the output of the photoelectric type sensor to produce the first electrical output.

5. A system according to claim 1, in which the characteristic wavelength is 4.4 microns.

6. A system for detecting fire or explosions emitting radiation having a characteristic wavelength and also emitting radiation at other wavelengths, comprising a thermopile detector to sense radiation in a narrow wavelength band including the characteristic wavelength and to produce a first electrical output dependent on the intensity of the sensed radiation, first threshold means connected to receive the first electrical output and to compare its magnitude with a predetermined threshold whereby to produce a first control output when the said magnitude exceeds the threshold, second, substantially instantaneously responsive, radiation sensing means to sense radiation in a narrow wavelength band including one of the other said wavelengths and producing a second electrical output dependent on the intensity of the radiation sensed, second threshold means connected to receive the second electrical output and to compare its magnitude with a predetermined threshold whereby to produce a second control signal when the said magnitude exceeds the threshold, means measuring the ratio of the first and second electrical outputs and producing a third control output only when the ratio of the first electrical to the second electrical output exceeds a predetermined value, and output means responsive to the first, second and third control outputs and operative to produce a fire or explosion indicating output only when all three control outputs exist at the same time.

* * * * *